US009737765B1

(12) United States Patent
Ogg et al.

(10) Patent No.: US 9,737,765 B1
(45) **Date of Patent: *Aug. 22, 2017**

(54) MULTIPLE LAYER GOLF BALL

(71) Applicant: Callaway Golf Company, Carlsbad, CA (US)

(72) Inventors: Steven S. Ogg, Carlsbad, CA (US); David M. Bartels, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 52 days.

This patent is subject to a terminal disclaimer.

(21) Appl. No.: 15/044,821

(22) Filed: Feb. 16, 2016

Related U.S. Application Data

(63) Continuation of application No. 14/180,615, filed on Feb. 14, 2014, now Pat. No. 9,259,620, which is a continuation of application No. 13/253,281, filed on Oct. 5, 2011, now Pat. No. 8,651,976.

(60) Provisional application No. 61/390,550, filed on Oct. 6, 2010.

(51) Int. Cl.

| | |
|---|---|
| ***A63B 37/04*** | (2006.01) |
| ***A63B 37/12*** | (2006.01) |
| ***A63B 37/00*** | (2006.01) |

(52) U.S. Cl.

CPC ..... *A63B 37/0092* (2013.01); *A63B 37/008* (2013.01); *A63B 37/0031* (2013.01); *A63B 37/0033* (2013.01); *A63B 37/0039* (2013.01); *A63B 37/0043* (2013.01); *A63B 37/0064* (2013.01); *A63B 37/0065* (2013.01); *A63B 37/0067* (2013.01); *A63B 37/0076* (2013.01); *A63B 37/0078* (2013.01)

(58) Field of Classification Search

USPC ..... 473/351–378

See application file for complete search history.

(56) References Cited

U.S. PATENT DOCUMENTS

| | | | | |
|---|---|---|---|---|
| 5,830,086 | A * | 11/1998 | Hayashi | A63B 37/0003 473/376 |
| 6,117,026 | A * | 9/2000 | Hayashi | A63B 37/0003 473/371 |
| 6,277,036 | B1 * | 8/2001 | Hayashi | A63B 37/0003 473/376 |
| 6,565,456 | B2 * | 5/2003 | Hayashi | A63B 37/0003 473/373 |
| 6,653,382 | B1 * | 11/2003 | Statz | C12N 9/16 473/372 |
| 6,743,122 | B2 * | 6/2004 | Hayashi | A63B 37/0003 473/376 |
| 7,148,279 | B2 * | 12/2006 | Voorheis | A63B 37/0003 473/372 |

(Continued)

FOREIGN PATENT DOCUMENTS

| | | | | |
|---|---|---|---|---|
| JP | 08336618 | A * | 12/1996 | A63B 37/0003 |

*Primary Examiner* — Alvin Hunter

(74) *Attorney, Agent, or Firm* — Michael A. Catania; Sonia Lari; Rebecca Hanovice

(57) ABSTRACT

A golf ball comprising a core comprising an inner core center and an outer core layer disposed over the inner core center. The inner core center has a deflection of greater than 0.210 inch under a load of 100 kilograms, and the entire the core has a deflection ranging from 0.130 inch to 0.105 inch under a load of 100 kilograms. A mantle layer is disposed over the core and a cover is disposed over the mantle.

15 Claims, 3 Drawing Sheets

(56) References Cited

U.S. PATENT DOCUMENTS

| | | | | |
|---|---|---|---|---|
| 7,175,542 | B2 * | 2/2007 | Watanabe | A63B 37/0004 473/374 |
| 7,230,045 | B2 * | 6/2007 | Rajagopalan | A63B 37/0004 473/372 |
| 7,402,114 | B2 * | 7/2008 | Binette | A63B 37/0003 473/373 |
| 7,625,302 | B2 * | 12/2009 | Watanabe | A63B 37/0004 473/376 |
| 8,425,351 | B2 * | 4/2013 | Ogg | A63B 37/0003 473/376 |
| 8,475,298 | B2 * | 7/2013 | Ogg | A63B 37/0003 473/376 |
| 8,651,976 | B1 * | 2/2014 | Ogg | A63B 37/0076 473/370 |
| 8,784,237 | B2 * | 7/2014 | Sullivan | A63B 37/0003 473/376 |

* cited by examiner

MULTIPLE LAYER GOLF BALL

CROSS REFERENCES TO RELATED APPLICATIONS

The Present Application is a continuation application of U.S. patent application Ser. No. 14/180,615, filed on Feb. 14, 2014, which is a continuation application of U.S. patent application Ser. No. 13/253,281, filed on Oct. 5, 2011, now U.S. Pat. No. 8,651,976, issued on Feb. 18, 2014, which claims priority to U.S. Provisional Patent Application No. 61/390,550, filed on Oct. 6, 2010, all of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention relates to the manufacture of golf balls. Particularly to golf balls having multiple layers.

Description of the Related Art

The prior art discloses various golf balls having dual cores. The golf balls typically have a single cover.

An example is U.S. Pat. No. 6,495,633, Dual Cores For Golf Balls.

BRIEF SUMMARY OF THE INVENTION

One aspect of the present invention is a golf ball comprising a core comprising an inner core center and an outer core layer disposed over the inner core center. The inner core center comprises a polybutadiene material and has a deflection of greater than 0.210 inch under a load of 100 kilograms. The core has a deflection ranging from 0.130 inch to 0.105 inch under a load of 100 kilograms. A mantle layer disposed over the core and a cover is disposed over the mantle. The golf ball has a diameter ranging form 1.65 inches to 1.685 inches.

Another aspect of the present invention is a golf ball comprising a core comprising an inner core center and an outer core layer disposed over the inner core center. The inner core center comprises a polybutadiene material and has a deflection of greater than 0.210 inch under a load of 100 kilograms, wherein the core has a deflection ranging from 0.120 inch to 0.095 inch under a load of 100 kilograms. The core has a diameter ranging from 1.40 inches to 1.64 inches. A mantle layer is disposed over the core and a cover is disposed over the mantle. The cover is composed of an ionomer material and has a thickness ranging 0.015 inch to 0.070 inch. The golf ball has a diameter ranging form 1.65 inches to 1.685 inches.

Yet another aspect of the present invention is a golf ball comprising a core, mantle layer and cover. The core has a diameter ranging from 1.40 inches to 1.64 inches. A mantle layer is disposed over the core and a cover is disposed over the mantle. The cover is composed of ionomer materials and has plaque Shore D hardness ranging from 50 to 62 and has a thickness ranging 0.015 inch to 0.070 inch. The golf ball has a diameter ranging form 1.65 inches to 1.685 inches.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
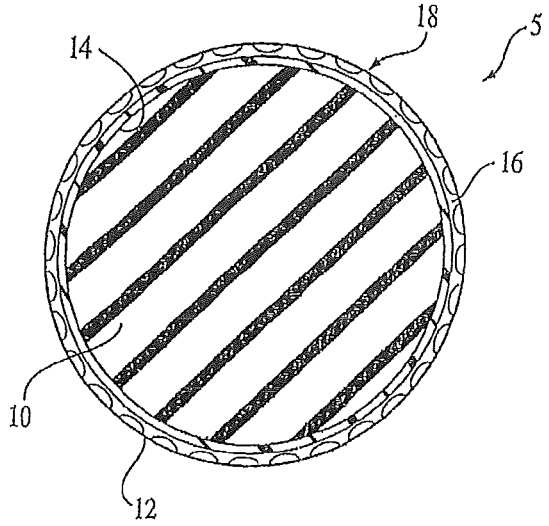
FIG. 1 is a cross-sectional view of a preferred embodiment of a golf ball of the present invention illustrating a core and a cover comprising an inner layer and an outer dimpled layer.

The present invention is directed to a golf ball comprising a dual-core component and a multi-layer cover. The present invention includes a variety of different embodiments as follows.

The novel multi-layer golf ball covers of the present invention include at least one polyurethane material. The multi-layer covers comprise an outer layer preferably formed from a polyurethane and may further include a high acid (greater than 16 weight percent acid) ionomer blend or, more preferably, a low acid (16 weight percent acid or less) ionomer blend. The multi-layer covers also comprise an inner layer or ply comprised of a comparatively softer, low modulus ionomer, ionomer blend or other non-ionomeric thermoplastic or thermosetting elastomer such as polyurethane or polyester elastomer. The multi-layer golf balls of the present invention can be of standard or enlarged size. Preferably, the inner layer or ply includes a blend of low acid ionomers and the outer cover layer comprises polyurethane.

The present invention golf balls utilize a unique dual-core configuration. Preferably, the cores comprise (i) an interior spherical center component formed from a thermoset material, a thermoplastic material, or combinations thereof; and (ii) a core layer disposed about the spherical center component, the core layer formed from a thermoset material, a thermoplastic material, or combinations thereof. The cores may further comprise (iii) an optional outer core layer disposed about the core layer. The outer core layer may be formed from a thermoset material, a thermoplastic material, or combinations thereof.

Although the present invention is primarily directed to golf balls comprising a multi-layer cover as described herein, the present invention also includes golf balls having a dual core component. Furthermore, the present invention also encompasses golf balls having a dual core component and a HPF mantle layer. Additionally, the present invention encompasses golf balls with solid one-piece cores and either multi-layer or single layer covers that are formed from ionomer materials.

It has been found that multi-layer golf balls having inner and outer cover layers exhibit higher C.O.R. values and have greater travel distance in comparison with balls made from a single cover layer. In addition, it has been found that use of an inner cover layer constructed of a blend of low acid (i.e., 16 weight percent acid or less) ionomer resins produces softer compression and higher spin rates than inner cover layers constructed of high acid ionomer resins.

Consequently, the overall combination of the unique dual core configuration, described in greater detail herein, and the multi-layer cover construction of inner and outer cover layers made, for example, from blends of low acid ionomer resins and polyurethane, results in a standard size or oversized golf ball having enhanced resilience (improved travel distance) and durability (i.e. cut resistance, etc.) characteristics while maintaining and in many instances, improving the ball's playability properties.

The combination of a low acid ionomer blend inner cover layer with a polyurethane based elastomer outer cover layer provides for good overall coefficient of restitution (i.e., enhanced resilience) while at the same time demonstrating improved compression. The polyurethane outer cover layer generally contributes to a more desirable feel.

Accordingly, the present invention is directed to a golf ball comprising a dual-core configuration and an improved multi-layer cover which produces, upon molding each layer around a core to formulate a multi-layer cover, a golf ball exhibiting enhanced distance (i.e., resilience) without adversely affecting, and in many instances, improving the ball's playability (hardness/softness) and/or durability (i.e., cut resistance, fatigue resistance, etc.) characteristics.

Figure 2:
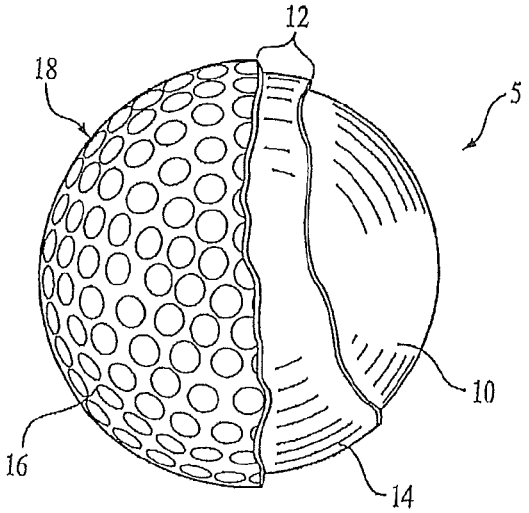
FIG. 2 is a diametrical cross-sectional view of the preferred embodiment of a the golf ball depicted in FIG. 1 having a core and a cover comprising an inner layer surrounding the core and an outer layer having a plurality of dimples.

FIGS. 1 and 2 illustrate a preferred embodiment golf ball 5 in accordance with the present invention. It will be understood that none of the referenced figures are to scale. And so, the thicknesses and proportions of the various layers and the diameter of the various core components are not necessarily as depicted. The golf ball 5 comprises a multi-layered cover 12 disposed about a core 10. The core 10 of the golf ball can be formed of a solid, a liquid, or any other substances that may be utilized to form the novel dual core described herein. The multi-layered cover 12 comprises two layers: a first or inner layer or ply 14 and a second or outer layer or ply 16. The inner layer 14 can be comprised of ionomer, ionomer blends, non-ionomer, non-ionomer blends, or blends of ionomer and non-ionomer. The outer layer 16 is preferably harder than the inner layer and can be comprised of ionomer, ionomer blends, non-ionomer, non-ionomer blends or blends of ionomer and non-ionomer. Although the outer cover layer is preferably harder than the inner cover layer, the present invention includes cover configurations in which the outer layer is softer than the inner layer.

In a first preferred embodiment, the inner layer 14 is comprised of a high acid (i.e. greater than 16 weight percent acid) ionomer resin or high acid ionomer blend. Preferably, the inner layer is comprised of a blend of two or more high acid (i.e., at least 16 weight percent acid) ionomer resins neutralized to various extents by different metal cations. The inner cover layer may or may not include a metal stearate (e.g., zinc stearate) or other metal fatty acid salt. The purpose of the metal stearate or other metal fatty acid salt is to lower the cost of production without affecting the overall performance of the finished golf ball. In a second embodiment, the inner layer 14 is comprised of a low acid (i.e., 16 weight percent acid or less) ionomer blend. Preferably, the inner layer is comprised of a blend of two or more low acid (i.e., 16 weight percent acid or less) ionomer resins neutralized to various extents by different metal cations. The inner cover layer may or may not include a metal stearate (e.g., zinc stearate) or other metal fatty acid salt.

Two principal properties involved in golf ball performance are resilience and hardness. Resilience is determined by the coefficient of restitution (C.O.R.), the constant "e" which is the ratio of the relative velocity of two elastic spheres after direct impact to that before impact. As a result, the coefficient of restitution ("e") can vary from 0 to 1, with 1 being equivalent to an elastic collision and 0 being equivalent to an inelastic collision.

Resilience (C.O.R.), along with additional factors such as club head speed, angle of trajectory and ball configuration (i.e., dimple pattern) generally determine the distance a ball will travel when hit. Since club head speed and the angle of trajectory are factors not easily controllable by a manufacturer, factors of concern among manufacturers are the coefficient of restitution (C.O.R.) and the surface configuration of the ball.

The coefficient of restitution (C.O.R.) in solid core balls is a function of the composition of the molded core and of the cover. In balls containing a dual core (i.e., balls comprising an interior spherical center component, a core layer disposed about the spherical center component, and a cover), the coefficient of restitution is a function of not only the composition of the cover, but also the composition and physical characteristics of the interior spherical center component and core layer. Both the dual core and the cover contribute to the coefficient of restitution in the golf balls of the present invention.

In this regard, the coefficient of restitution of a golf ball is generally measured by propelling a ball at a given speed against a hard surface and measuring the ball's incoming and outgoing velocities electronically. As mentioned above, the coefficient of restitution is the ratio of the outgoing velocity to the incoming velocity. The coefficient of restitution must be carefully controlled in all commercial golf balls in order for the ball to be within the specifications regulated by the United States Golf Association (U.S.G.A.) Along this line, the U.S.G.A. standards indicate that a "regulation" ball cannot have an initial velocity (i.e., the speed off the club) exceeding 255 feet per second. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

Dual Core

As noted, the present invention golf balls utilize a unique dual core configuration. Preferably, the cores comprise (i) an interior spherical center component formed from a thermoset material, a thermoplastic material, or combinations thereof and (ii) a core layer disposed about the spherical center component, the core layer formed from a thermoset material, a thermoplastic material, or combinations thereof. Most preferably, the core layer is disposed immediately adjacent to, and in intimate contact with the center component. The cores may further comprise (iii) an optional outer core layer disposed about the core layer. Most preferably, the outer core layer is disposed immediately adjacent to, and in intimate contact with the core layer. The outer core layer may be formed from a thermoset material, a thermoplastic material, or combinations thereof.

Figure 3:
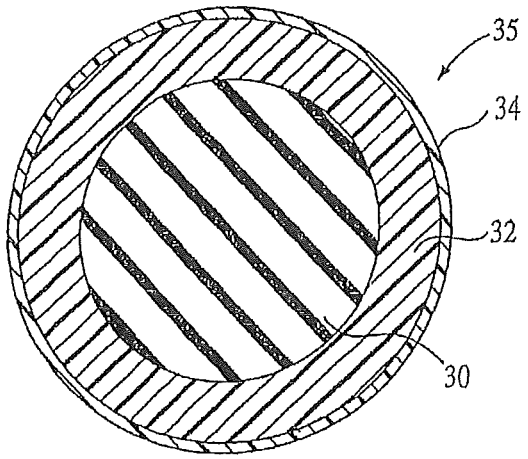
FIG. 3 is a cross-sectional view of another preferred embodiment of a golf ball of the present invention comprising a dual core component.

The present invention provides several additionally preferred embodiment golf balls utilizing the unique dual core configuration and the previously described cover layers. Referring to FIG. 3, a preferred embodiment golf ball 35 is illustrated comprising a core 30 formed from a thermoset material surrounded by a core layer 32 formed from a thermoplastic material. A multi-layer cover 34 surrounds the core 30 and core layer 32. The multi-layer cover 34 preferably corresponds to the previously described multi-layer cover 12.

Figure 4:
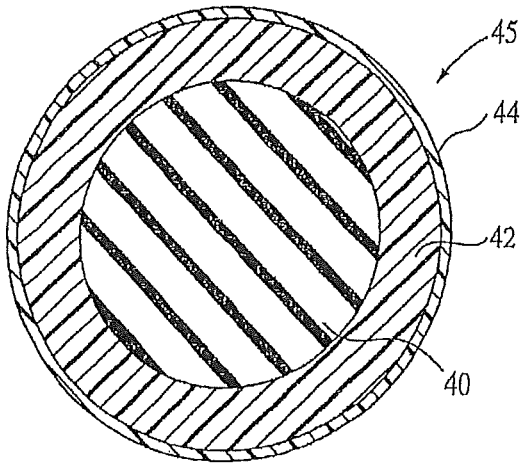
FIG. 4 is a cross-sectional view of yet another preferred embodiment of a golf ball of the present invention comprising a dual core component.

As illustrated in FIG. 4, another preferred embodiment golf ball 45 in accordance with the present invention is illustrated. The preferred embodiment golf ball 45 comprises a core 40 formed from a thermoplastic material surrounded by a core layer 42. The core layer 42 is formed from a thermoset material. A multi-layer cover 44 surrounds the core 40 and the core layer 42. Again, the multi-layer cover 44 preferably corresponds to the previously described multi-layer cover 12.

Figure 5:
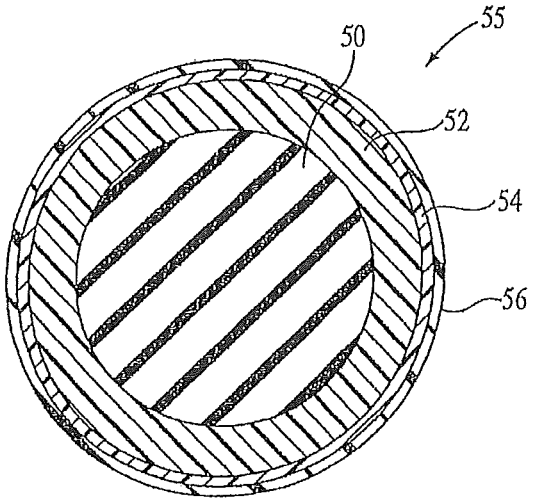
FIG. 5 is a cross-sectional view of another preferred embodiment of a golf ball of the present invention comprising a dual core component and an outer core layer.

FIG. 5 illustrates yet another preferred embodiment golf ball 55 in accordance with the present invention. The preferred embodiment golf ball 55 comprises a core 50 formed from a thermoplastic material. A core layer 52 surrounds the core 50. The core layer 52 is formed from a thermoplastic material which may be the same as the material utilized with the core 50, or one or more other or different thermoplastic materials. The preferred embodiment golf ball 55 utilizes an optional outer core layer 54 that surrounds the core component 50 and the core layer 52. The outer core layer 54 is formed from a thermoplastic material which may be the same or different than any of the thermoplastic materials utilized by the core 50 and the core layer 52. The golf ball 55 further comprises a multi-layer cover 56 that is preferably similar to the previously described multi-layer cover 12.

Figure 6:
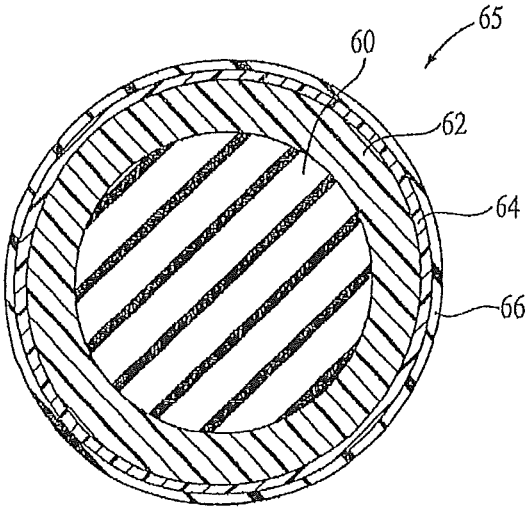
FIG. 6 is a cross-sectional view of yet another preferred embodiment of a golf ball of the present invention comprising a dual core component and an outer core layer.

FIG. 6 illustrates yet another preferred embodiment golf ball 65 in accordance with the present invention. The preferred embodiment golf ball 65 comprises a core 60 formed from a thermoplastic, thermoset material, or any combination of a thermoset and thermoplastic material. A core layer 62 surrounds the core 60. The core layer 62 is formed from a thermoset material. The preferred embodiment golf ball 65 also comprises an optional outer core layer 64 formed from a thermoplastic material. A multi-layer cover 66, preferably similar to the previously described multi-layer cover 12, is disposed about, and generally surrounds, the core 60, the core layer 62 and the outer core 64.

A wide array of thermoset materials can be utilized in the present invention dual cores. Examples of suitable thermoset materials include butadiene or any natural or synthetic elastomer, including metallocene polyolefins, polyurethanes, silicones, polyamides, polyureas, or virtually any irreversibly cross-linked resin system. It is also contemplated that epoxy, phenolic, and an array of unsaturated polyester resins could be utilized.

The thermoplastic material utilized in the present invention golf balls and, particularly their dual cores, may be nearly any thermoplastic material. Examples of typical thermoplastic materials for incorporation in the golf balls of the present invention include, but are not limited to, ionomers, polyurethane thermoplastic elastomers, and combinations thereof. It is also contemplated that a wide array of other thermoplastic materials could be utilized, such as polysulfones, fluoropolymers, polyamide-imides, polyarylates, polyaryletherketones, polyaryl sulfones/polyether sulfones, polybenzimidazoles, polyether-imides, polyimides, liquid crystal polymers, polyphenylene sulfides; and specialty high-performance resins, and ultrahigh molecular weight polyethylenes.

Additional examples of suitable thermoplastics include metallocenes, polyvinyl chlorides, acrylonitrile-butadiene-styrenes, acrylics, styrene-acrylonitriles, styrene-maleic anhydrides, polyamides (nylons), polycarbonates, polybutylene terephthalates, polyethylene terephthalates, polyphenylene ethers/polyphenylene oxides, reinforced polypropylenes, and high-impact polystyrenes.

Preferably, the thermoplastic materials have relatively high melting points, such as a melting point of at least about 300° F. Several examples of these preferred thermoplastic materials and which are commercially available include, but are not limited to, Capron® (a blend of nylon and ionomer), Lexan® polycarbonate, Pebax®, and Hytrel®. The polymers or resin system may be cross-linked by a variety of means such as by peroxide agents, sulphur agents, radiation or other cross-linking techniques.

Any or all of the previously described components in the cores of the golf ball of the present invention may be formed in such a manner, or have suitable fillers added, so that their resulting density is decreased or increased. For example, any of these components in the dual cores could be formed or otherwise produced to be light in weight. For instance, the components could be foamed, either separately or in-situ. Related to this, a foamed light weight filler agent may be added. In contrast, any of these components could be mixed with or otherwise receive various high density filler agents or other weighting components such as relatively high density fibers or particulate agents in order to increase their mass or weight.

The cores of the inventive golf balls typically have a coefficient of restitution of about 0.750 or more, more preferably 0.770 or more and a PGA compression of about 100 or less, and more preferably 80 or less. The cores have a weight of 25 to 40 grams and preferably 30 to 40 grams. The core can be compression molded from a slug of uncured or lightly cured elastomer composition comprising a high cis content polybutadiene and a metal salt of an alpha, beta-ethylenically unsaturated carboxylic acid such as zinc mono- or diacrylate or methacrylate. To achieve higher coefficients of restitution and/or to increase hardness in the core, the manufacturer may include a small amount of a metal oxide such as zinc oxide. In addition, larger amounts of metal oxide than are needed to achieve the desired coefficient may be included in order to increase the core weight so that the finished ball more closely approaches the U.S.G.A. upper weight limit of 1.620 ounces. Non-limiting examples of other materials which may be used in the core composition include compatible rubbers or ionomers, and low molecular weight fatty acids such as stearic acid. Free radical initiator catalysts such as peroxides are admixed with the core composition so that on the application of heat and pressure, a curing or cross-linking reaction takes place.

Wound cores are generally produced by winding a very long elastic thread around a solid or liquid filled balloon center. The elastic thread is wound around the center to produce a finished core of about 1.4 to 1.6 inches in diameter, generally. However, the preferred embodiment golf balls of the present invention preferably utilize a solid core, or rather a solid dual core configuration, as opposed to a wound core.

Method of Making Golf Ball

In preparing golf balls in accordance with the present invention, a soft inner cover layer is molded (preferably by injection molding or by compression molding) about a core (preferably a solid core, and most preferably a dual core). A comparatively harder outer layer is molded over the inner layer.

The dual cores of the present invention are preferably formed by compression molding techniques. However, it is fully contemplated that liquid injection molding or transfer molding techniques could be utilized.

In a particularly preferred embodiment of the invention, the golf ball has a dimple pattern which provides coverage of 65% or more. The golf ball typically is coated with a durable, abrasion-resistant, relatively non-yellowing finish coat.

The various cover composition layers of the present invention may be produced according to conventional melt blending procedures. Generally, the copolymer resins are blended in a Banbury® type mixer, two-roll mill, or extruder prior to neutralization. After blending, neutralization then occurs in the melt or molten states in the Banbury® mixer. Mixing problems are minimal because preferably more than 75 wt %, and more preferably at least 80 wt % of the ionic copolymers in the mixture contain acrylate esters and, in this respect, most of the polymer chains in the mixture are similar to each other. The blended composition is then formed into slabs, pellets, etc., and maintained in such a state until molding is desired. Alternatively, a simple dry blend of the pelletized or granulated resins, which have previously been neutralized to a desired extent, and colored masterbatch may be prepared and fed directly into the injection molding machine where homogenization occurs in the mixing section of the barrel prior to injection into the mold. If necessary, further additives such as an inorganic filler, etc., may be added and uniformly mixed before initiation of the molding process. A similar process is utilized to formulate the high acid ionomer resin compositions used to produce the inner cover layer. In one embodiment of the invention, a masterbatch of non-acrylate ester-containing ionomer with pigments and other additives incorporated therein is mixed with the acrylate ester-containing copolymers in a ratio of about 1-7 weight % masterbatch and 93-99 weight % acrylate ester-containing copolymer.

The golf balls of the present invention can be produced by molding processes which include but are not limited to those which are currently well known in the golf ball art. For example, the golf balls can be produced by injection molding or compression molding the novel cover compositions around a wound or solid molded core to produce an inner ball which typically has a diameter of about 1.50 to 1.67 inches. The core, preferably of a dual core configuration, may be formed as previously described. The outer layer is subsequently molded over the inner layer to produce a golf ball having a diameter of 1.620 inches or more, preferably about 1.680 inches or more. Although either solid cores or wound cores can be used in the present invention, as a result of their lower cost and superior performance solid molded cores are preferred over wound cores. The standards for both the minimum diameter and maximum weight of the balls are established by the United States Golf Association (U.S.G.A.).

In compression molding, the inner cover composition is formed via injection at about 380° F. to about 450° F. into smooth surfaced hemispherical shells which are then positioned around the core in a mold having the desired inner cover thickness and subjected to compression molding at 200° to 300° F. for about 2 to 10 minutes, followed by cooling at 50° to 70° F. for about 2 to 7 minutes to fuse the shells together to form a unitary intermediate ball. In addition, the intermediate balls may be produced by injection molding wherein the inner cover layer is injected directly around the core placed at the center of an intermediate ball mold for a period of time in a mold temperature of from 50° to about 100° F. Subsequently, the outer cover layer is molded around the core and the inner layer by similar compression or injection molding techniques to form a dimpled golf ball of a diameter of 1.680 inches or more.

Some of the unique characteristics exhibited by a golf ball according to the present invention include a thinner cover without the accompanying disadvantages otherwise associated with relatively thin covers such as weakened regions at which inconsistent compositional or structural differences exist. A traditional golf ball cover typically has a thickness in the range of about 0.060 inches to 0.080 inches. A golf ball of the present invention may utilize a cover having a thickness of about 0.015 inches 0.045 inches. This reduced cover thickness is often a desirable characteristic. It is contemplated that thinner layer thicknesses are possible using the present invention.

After molding, the golf balls produced may undergo various further processing steps such as buffing, painting and marking as disclosed in U.S. Pat. No. 4,911,451.

Various aspects of the present invention golf balls have been described in terms of certain tests or measuring procedures. These are described in greater detail as follows.

Shore D Hardness

As used herein, "Shore D hardness" of a cover is measured generally in accordance with ASTM D-2240, except the measurements are made on the curved surface of a molded cover, rather than on a plaque. Furthermore, the Shore D hardness of the cover is measured while the cover remains over the core. When a hardness measurement is made on a dimpled cover, Shore D hardness is measured at a land area of the dimpled cover.

Coefficient of Restitution

The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration (i.e., dimple pattern and area of dimple coverage) as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the coefficient of restitution (COR) and the surface configuration (dimple pattern, ratio of land area to dimple area, etc.) of the ball.

The COR in solid core balls is a function of the composition of the molded core and of the cover. The molded core and/or cover may be comprised of one or more layers such as in multi-layered balls. In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of Oehler Mark 55 ballistic screens available from Oehler Research, Inc., P.O. Box 9135, Austin, Tex. 78766, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The coefficient of restitution must be carefully controlled in all commercial golf balls if the ball is to be within the specifications regulated by the United States Golf Association (U.S.G.A.). As mentioned to some degree above, the U.S.G.A. standards indicate that a "regulation" ball cannot have an initial velocity exceeding 255 feet per second in an atmosphere of 75° F. when tested on a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

Four golf balls in accordance with the present invention were formed, each using a preferred and commercially available high melting point thermoplastic material as an inner core component.

The invention has been described with reference to the preferred embodiments. Obviously, modifications and alterations will occur to others upon a reading and understanding the preceding detailed description. It is intended that the invention be construed as including all such modifications and alterations in so far as they come within the scope of the appended claims or the equivalents thereof.

The hardness of the ball is the second principal property involved in the performance of a golf ball. The hardness of the ball can affect the playability of the ball on striking and the sound or "click" produced. Hardness is determined by the deformation (i.e., compression) of the ball under various load conditions applied across the ball's diameter (i.e., the lower the compression value, the harder the material).

In one embodiment of the present invention of a golf ball, the golf ball comprises an inner core center and an outer core layer disposed over the inner core center. The inner core center comprises a polybutadiene material and has a deflection of greater than 0.210 inch under a load of 100 kilograms, wherein the core has a deflection ranging from 0.130 inch to 0.105 inch under a load of 100 kilograms. A mantle layer is disposed over the core and a cover is disposed over the mantle. The golf ball preferably has a diameter ranging from 1.65 inches to 1.685 inches.

Preferably, the golf ball cover is composed of a polyurethane material. The golf ball cover has a thickness ranging from 0.015 inch to 0.030 inch. The mantle layer is preferably composed of an ionomer material. Alternatively, the mantle layer is composed of a blend of ionomer materials. Alternatively, the mantle layer is composed of a highly neutralized ionomer material. The mantle layer preferably has a thickness ranging from 0.030 inch to 0.075 inch. The core preferably has a diameter ranging from 1.40 inches to 1.64 inches. Preferably, the golf ball has a coefficient of restitution greater than 0.79.

In another embodiment of the present invention the golf ball comprises a core comprising an inner core center and an outer core layer disposed over the inner core center. The inner core center comprises a polybutadiene material and has a deflection of greater than 0.210 inch under a load of 100 kilograms. The core has a deflection ranging from 0.120 inch to 0.095 inch under a load of 100 kilograms. A mantle layer is disposed over the core and a cover is disposed over them mantle. The cover is composed of an ionomer material and has a thickness ranging from 0.015 inch to 0.050 inch. The golf ball has a diameter ranging from 1.65 inches to 1.685 inches.

Preferably, the mantle layer is composed of an ionomer material. Alternatively, the mantle layer is composed of a blend of ionomer materials. Alternatively, the mantle layer is composed of a highly neutralized ionomer material. Preferably, the mantle layer has a thickness ranging from 0.030 inch to 0.075 inch.

In yet another embodiment, the golf ball of the present invention comprises a core comprising an inner core center and an outer core layer disposed over the inner core center. The inner core center comprises a polybutadiene material and has a deflection of greater than 0.210 inch under a load of 100 kilograms, wherein the core has a deflection ranging from 0.120 inch to 0.095 inch under a load of 100 kilograms. The core has a diameter ranging from 1.40 inches to 1.64 inches. A mantle layer is disposed over the core and a cover is disposed over the mantle. The cover is composed of an ionomer material and has a thickness ranging from 0.015 inch to 0.050 inch. The golf ball has a diameter ranging from 1.65 inches to 1.685 inches.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf ball comprising:

a core comprising an inner core center and an outer core layer disposed over the inner core center, the inner core center comprising a polybutadiene material and having a deflection of greater than 0.210 inch under a load of 100 kilograms, wherein the core has a deflection ranging from 0.130 inch to 0.105 inch under a load of 100 kilograms, wherein the core has a mass ranging from 25 grams to 40 grams;

a mantle layer disposed over the core, the mantle composed of a highly neutralized material and the material having a plaque Shore D hardness less than 53; and a cover disposed over the mantle, the cover composed of a cover material having a plaque Shore D hardness ranging from 50 to 62, wherein the cover has a thickness ranging from 0.015 inch to 0.030;

wherein the golf ball has a diameter ranging from 1.65 inches to 1.685 inches.

2. The golf ball according to claim 1, wherein the mantle layer has a plaque Shore D hardness ranging from 44 to 50.

3. The golf ball according to claim 1 wherein the mantle layer has a thickness ranging from 0.030 inch to 0.075 inch.

4. The golf ball according to claim 1 wherein the core has diameter ranging from 1.40 inches to 1.64 inches.

5. The golf ball according to claim 1 wherein the golf ball has a coefficient of restitution greater than 0.79.

6. A golf ball comprising:

a core comprising an inner core center and an outer core layer disposed over the inner core center, the inner core center comprising a polybutadiene material and having a deflection of greater than 0.210 inch under a load of 100 kilograms, the outer core comprising a polybutadiene material, wherein the core has a deflection ranging from 0.130 inch to 0.105 inch under a load of 100 kilograms, wherein the core has a mass ranging from 25 grams to 40 grams, wherein the core has a diameter ranging from 1.40 inches to 1.64 inches;

a mantle layer disposed over the core, the mantle composed of a highly neutralized material and the material having a plaque Shore D hardness less than 53; and a cover disposed over the mantle, the cover composed of a cover material comprising a thermoplastic polyurethane, wherein the cover has a thickness ranging from 0.015 inch to 0.030;

wherein the golf ball has a diameter ranging from 1.65 inches to 1.685 inches.

7. The golf ball according to claim 6 wherein the inner core has PGA compression less 50.

8. The golf ball according to claim 6 wherein the mantle has a plaque Shore D hardness ranging from 44 to 50.

9. The golf ball according to claim 6 wherein the mantle layer has a thickness ranging from 0.030 inch to 0.075 inch.

10. A golf ball comprising:

a core comprising an inner core center and an outer core layer disposed over the inner core center, the inner core center comprising a polybutadiene material and having a deflection of greater than 0.210 inch under a load of 100 kilograms, wherein the core has a deflection ranging from 0.130 inch to 0.105 inch under a load of 100 kilograms, wherein the core has a mass ranging from 25 grams to 40 grams;

a mantle layer disposed over the core, the mantle composed of a highly neutralized material and the material having a plaque Shore D hardness less than 53; and a cover disposed over the mantle, the cover composed of a cover material comprising a thermoplastic polyurethane material, the cover material having a plaque Shore D hardness ranging from 50 to 62, wherein the cover has a thickness ranging from 0.015 inch to 0.045 inch;

wherein the golf ball has a diameter ranging from 1.65 inches to 1.685 inches.

11. The golf ball according to claim 10 wherein the inner core has PGA compression less 50.

12. The golf ball according to claim 10 wherein the mantle has a plaque Shore D hardness ranging from 44 to 50.

13. The golf ball according to claim 10 wherein the mantle layer has a thickness ranging from 0.030 inch to 0.075 inch.

14. The golf ball according to claim 10 wherein the core has diameter ranging from 1.40 inches to 1.64 inches.

15. The golf ball according to claim 10 wherein the golf ball has a coefficient of restitution greater than 0.79.

* * * * *